US005351534A

United States Patent [19]

Lessi

[11] Patent Number: 5,351,534

[45] Date of Patent: Oct. 4, 1994

[54] METHOD AND DEVICE FOR PRODUCTION LOGGING IN A GUSHING WELL

[75] Inventor: Jacques Lessi, Maule, France

[73] Assignee: Institut Francais du Petrole, Malmaison Cedex, France

[21] Appl. No.: 877,382

[22] Filed: Apr. 29, 1992

Related U.S. Application Data

[63] Continuation of Ser. No. 497,266, Mar. 22, 1990, abandoned.

[30] Foreign Application Priority Data

Mar. 22, 1989 [FR] France ..... 89 03886

[51] Int. Cl.[5] ..... E21B 49/08

[52] U.S. Cl. ..... 73/155

[58] Field of Search ..... 73/155, 152; 166/250, 166/142

[56] References Cited

U.S. PATENT DOCUMENTS

| | | | |
|---|---|---|---|
| 2,962,895 | 12/1960 | Rumble | 73/155 |
| 3,059,695 | 10/1962 | Barry et al. | 166/264 |
| 3,103,811 | 9/1963 | Ayres et al. | 73/152 |
| 3,103,812 | 9/1963 | Bourne, Jr. et al. | 73/155 |
| 3,103,813 | 9/1963 | Bourne, Jr. et al. | 73/155 |
| 3,123,708 | 3/1964 | Limanek | 250/258 |
| 3,224,267 | 12/1965 | Harlan et al. | 73/155 |
| 3,248,938 | 5/1966 | Hill et al. | 73/155 |
| 3,283,570 | 11/1966 | Hodges | 73/155 |
| 3,369,395 | 2/1968 | Scott et al. | 73/152 |
| 3,454,085 | 7/1969 | Bostock | 166/66 |
| 3,472,070 | 10/1969 | Chenoweth | 73/155 |
| 3,478,584 | 11/1969 | Strubhar et al. | 73/155 |
| 4,006,630 | 2/1977 | Cathriner | 73/155 |
| 4,314,476 | 2/1982 | Johnson | 73/155 |
| 4,353,249 | 10/1982 | Lagus et al. | 73/155 |
| 4,386,531 | 6/1983 | Heimgartner et al. | 73/155 |
| 4,598,771 | 7/1986 | Vann | 73/155 |
| 4,633,952 | 1/1987 | Ringgenberg | 166/250 |
| 4,635,717 | 1/1987 | Jageler | 166/250 |
| 4,674,328 | 6/1987 | Ward et al. | 73/152 |
| 4,699,216 | 10/1987 | Rankin | 166/385 |
| 4,790,378 | 12/1988 | Montgomery et al. | 73/155 |
| 4,838,079 | 6/1989 | Harris | 73/155 |
| 4,942,923 | 7/1990 | Geeting | 166/250 |

FOREIGN PATENT DOCUMENTS

| | | | |
|---|---|---|---|
| 48601 | 1/1986 | Fed. Rep. of Germany | 166/250 |
| 1322402 | 12/1963 | France . | |
| 2200934 | 8/1988 | United Kingdom . | |

OTHER PUBLICATIONS

Propagation of Electromagnetic Waves Along A Drillstring of Finite Conductivity, SPE Drilling Engineering, Jun. 1987.

*Primary Examiner*—Hezron E. Williams
*Assistant Examiner*—Michael Brock
*Attorney, Agent, or Firm*—Antonelli, Terry, Stout & Kraus

[57] ABSTRACT

A process and a device for creating production logs in a gushing well. A seal permits measurement of at least part of the upstream flow and/or downstream flow in the well relative to the seal. The pressure differential is monitored on either side of the seal.

17 Claims, 3 Drawing Sheets

METHOD AND DEVICE FOR PRODUCTION LOGGING IN A GUSHING WELL

Figure 1:
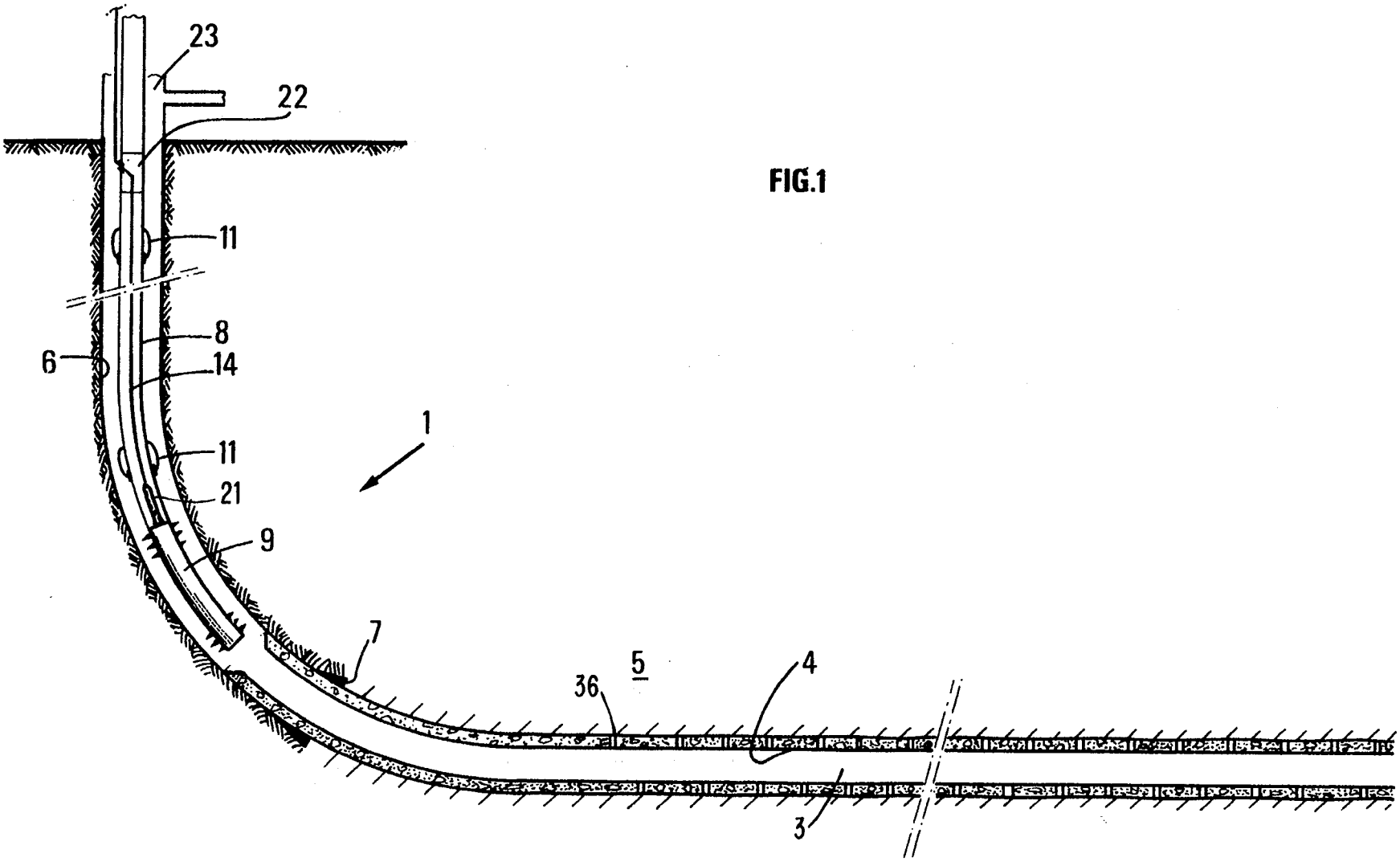

This application is a continuation of application Ser. No. 07/497,266 now abandoned, Mar. 22,1990.

The present invention relates to a method and device for making production logs in gushing as producing wells, particularly inclined or horizontal wells.

It should first be pointed out that production well logs may play an essential role in the exploitation strategy of an oil well, particularly a horizontal or strongly inclined well, if the logs can be produced correctly. It is generally assumed that a horizontal well can replace several vertical wells (generally two to four) both from the standpoint of the well output (increase in production index) and from the stand point of recovery (increase in drainage area and decreased coning problems).

Although this recognized dual advantage of a horizontal well is valid in the case of a homogenous reservoir, it may be less so in the far less frequent case of a heterogeneous reservoir. Because of irregularities, the overall output of the well may become unprofitable because of incoming water that may be characterized by a water-cut ratio (quantity of water/quantity of liquid) or a gas-oil ratio (GOR) that is too high. This output may have to be reduced, for example to limit the GOR to an acceptable value, even though this production problem may involve only a limited area of the hole. Even though this type of problem does not mean that horizontal wells have to be ruled out altogether in this type of deposit, it is clear that a horizontal well does not offer the flexibility the producer may desire to optimize exploitation of the field. Also, it should be noted that the totality of vertical wells that may replace the horizontal well would offer more opportunities, with the vertical well draining the part of the reservoir responsible for the production problem being able to be closed easily without injuring production of other wells.

The obvious way of avoiding this problem is to use selective completion in the horizontal hole, allowing production to be tuned zone by zone or the problematical drainage zone to be closed.

Selective completion may be used at two different stages in the life of a well: either immediately after drilling the well or later, at the time when its necessity becomes apparent.

In the first case, it is clear that the decision to use selective completion is a difficult one for several reasons:

first of all the additional investment represented by selective completion equipment must be justified a priori, then the zones to be individualized must be defined from a static description of the reservoir.

It is advantageous to postpone the decision until the situation is better known so that the additional outlay will be made only for the wells requiring it and only at the time it becomes necessary. In most cases, it will only be done after the well has broken even. On the other hand, it might be easier to define the zones to be isolated if more dynamic data were available on the reservoir, particularly by using well logs.

Further, intervention may be made difficult or even impossible because of the provisional completion used during the first phase of well operation, for example the use of a non-cemented perforated liner (generally called "preperforated liner" by specialists).

In addition, this method of production (first phase non-selective, second phase selective) may in certain cases be the reason for a drop in eventual recovery.

The first solution (selectivity from the very start of production) thus appears to be more attractive technically, but not necessarily economically. The solution of cementing and perforating a liner throughout the length of the hole, which solution allows for any selection possibility thereafter, must be discarded in certain cases for cost reasons.

The best solution thus consists of carrying out the first phase of production in an open hole; however this is not always possible because of uncertainties regarding the mechanical stability of the well.

As a result, the case most frequently encountered is that of the non-cemented well.

Whatever the completion used for a horizontal well, when there a problem of producing undesirable fluids, it becomes important to pinpoint which zone or zones is or are responsible for this production, and to evaluate the potential of the well with these zones closed.

Only production well logs can provide the necessary answers. Yet their implementation comes up against difficulties linked to the horizontality and to the completion method.

Of all possible selective completion methods (total or partial cementing, formation packers) or nonselective completion methods (open-hole, preperforated liner), the case of the perforated liner presents the most difficulties. This is the case that will be considered below.

The present invention relates to the case where the well is gushing and does not have to be activated to produce.

The present invention can also be applied to vertical wells.

The essential goal of production well logging is to furnish the flow profile of each phase along the hole. This result is obtained by making and interpreting one or more flow measurements. According to the present invention, it is possible to make these measurements at the surface, rather than directly at the bottom of the well.

The measuring means may for example measure flows of an effluent as a whole, or the various phases of this effluent, possibly by separating these phases.

According to the present invention, tubing is used to lower a sealing means.

While implementation of the system according to the present invention may at first appear more cumbersome and more complex than that of a classical well log, it should be noted that, on the one hand, such classical well logging may be insufficiently accurate and, on the other hand, these measurements will be made only when selective intervention ( selective completion or selective treatment ) becomes necessary and in any event requires equipment to be removed from the well.

Implementation of well logging with the aid of tubing assumes, to simplify interpretation, that the distribution of the pressures in the hole is not too greatly modified by the position of the tubing string in the hole, i.e. the pressure losses in the annular gap between the tubing and the perforated liner are negligible. This point may be verified during measurement by using a pressure sensor or sensors to evaluate the pressure loss in the gap.

According to the present invention, when the well is gushing, the tubing is not equipped with a well activation pump.

Thus, the present invention relates to a method for making well logs in a gushing well. According to this method, effluents are produced on either side of sealing means, the pressure differential between the two sides of said sealing means is measured, and measuring means are used to process at least some of the effluents coming from upstream and/or downstream of the flow, relative to said sealing means.

The flows can be processed at the surface by measuring means. These measuring means may be flowmeters.

The measuring means may process at least part of or substantially all of the upstream flow.

The measuring means may process at least part of or substantially all of the downstream flow.

The pressure differential in the producing well on both sides of the sealing means may be monitored from the surface.

If the upstream and/or downstream flow measurements are made in the well, preservation balances may be calculated by comparison with the total flow measurement at the surface.

The present invention also relates to a device for producing well logs in a gushing well. This device has sealing means, measuring means designed to process at least part of the upstream flow and/or downstream flow relative to said sealing means, and means for monitoring the pressure differential between the two sides of the sealing means.

The measuring means may be located at the surface.

The monitoring means may include means for measuring the pressures or pressure differentials between the two sides of the sealing means.

The monitoring means may include, at the surface, means for adjusting the pressure differential from one side to the other of said sealing means.

The pressure-measuring means may measure the pressure differential and at least one of the upstream or downstream pressures prevailing on either side of the sealing means.

The sealing means may be attached to one end of the tubing, with the other end of the tubing emerging at the surface.

The flow coming essentially from upstream of the sealing means may be sent to the surface via the tubing.

The flow coming from downstream of the sealing means may be sent to the surface via the annular gap between the well walls and the outer walls of the tubing.

The tubing may include shutoff means.

The tubing may include a connection with a lateral inlet for a cable.

Transmission of information between the well and the surface may be accomplished by electrical cable or by electromagnetic waves.

The present invention also relates to the application of the method or device described above, to a horizontal or inclined well.

Figure 2:
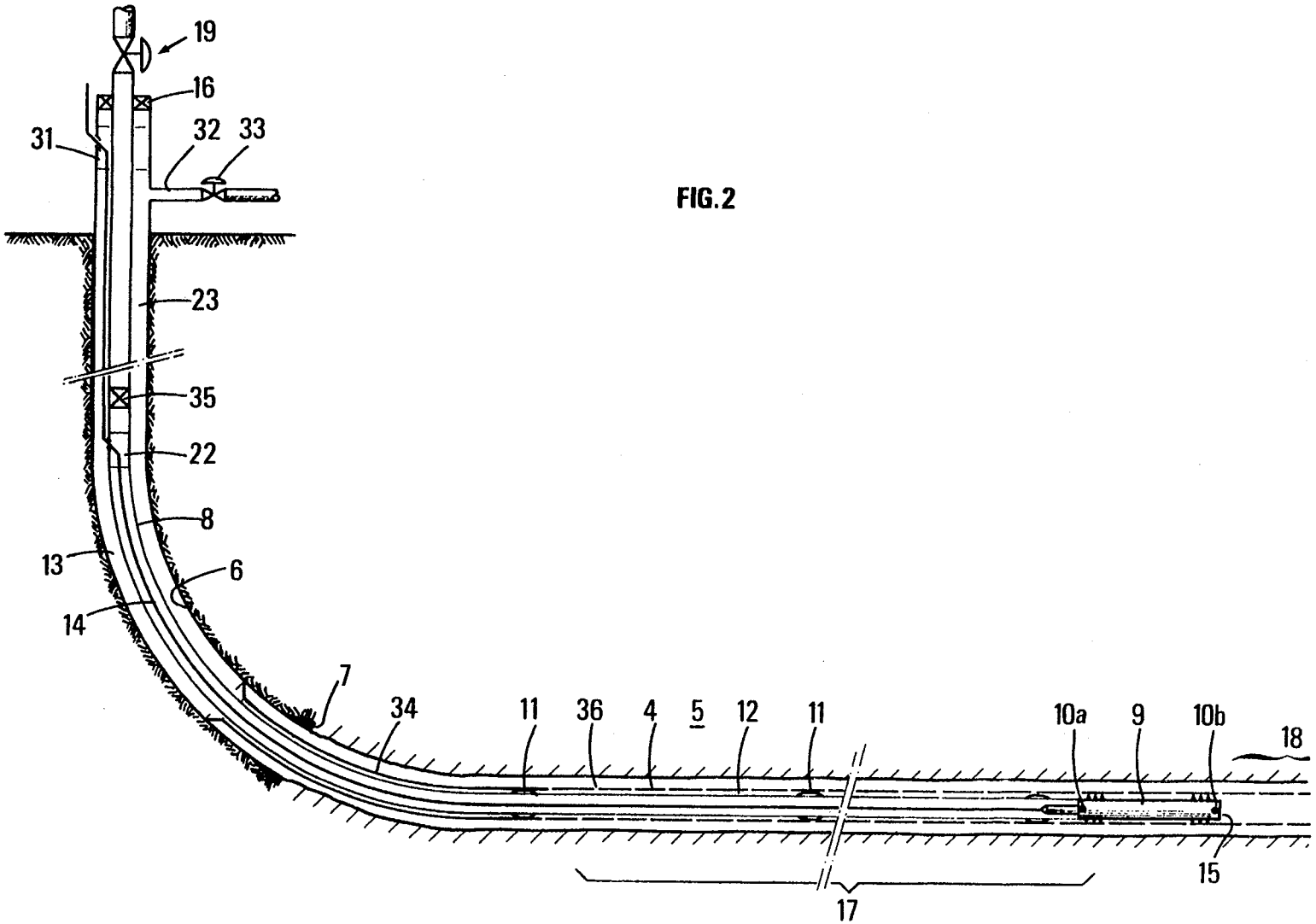
Figure 3:
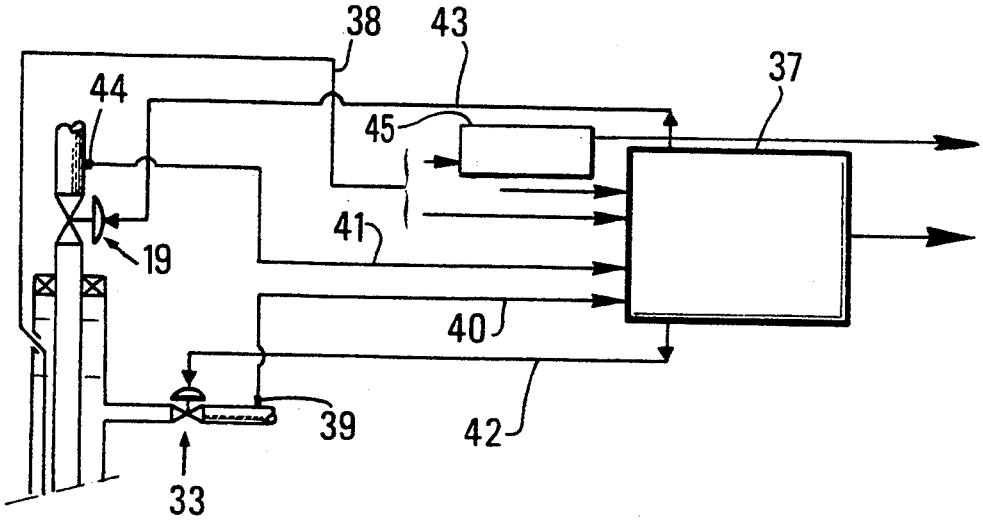

The present invention will be better understood and its advantages will emerge more clearly from the description below of particular and non-limitative examples illustrated by the attached figures wherein:

FIG. 1 represents one embodiment of the device according to the invention when it is being installed, FIG. 2 illustrates this embodiment once the device is in place, FIG. 3 show s schematically the pressure differential monitoring means.

FIG. 1 represents a producing well 1 in which it is desired to measure the flow characteristics of the fluid linked to the formation along the part of the well in production. These measurements will show the variation in certain characteristics between various points in the producing zone of well 1. This well has a substantially vertical part, not shown, and a part 3 that is substantially horizontal or inclined with respect to the vertical, in which oil production takes place in normal operation.

This producing zone has a liner 4 perforated over at least part of its length. During production, the fluid from geological formation 5 flows through these perforations.

The purpose of the present invention is to obtain information on these flows in different ways for different points in the producing part of the well.

Such information may be the flowrate, or the composition of the product mix. The present invention will give information in particular on flowrate as a function of the curved abscissa along the production hole. Thus, for example, it is possible to determine the portions of the hole in which essentially water is produced, and to take action regarding these portions.

Reference 6 designates the casing of the well in the non-producing zone and reference 7 is the shoe at the end of the casing.

According to the present invention, tubing 8 having sealing means 9 is lowered into the well.

It is recommended that protectors or centering devices 11 be used in the slanting and horizontal parts of the well.

Reference 12 designates the annular gap between liner 4 and tubing 8 (FIG. 2). It is in this zone that protectors 11 are located.

Liner 4 may be cemented as shown in FIG. 1 or not (FIG. 2).

The information from pressure sensors 10*a*, 10*b* and sensor 10*c* is transmitted to the surface by an electrical cable 14 located partly in tubing 8, as well as in annular gap 23 between the tubing and casing 6 over part of the length of the tubing. This arrangement allows the electrical connection between the motor and the cable to be made at the surface. Electrical cable 14 is payed out at the surface, keeping pace with the assembling of the elements of which tubing 8 is composed. This assembly work is accompanied by increasing penetration of the sealing means into the well.

Tubing 8 is sealed off over its running length from annular gap 12. The fluid that penetrates the tubing is the fluid that penetrates inside sealing means 9, which are hollow and have a flow channel in side.

Sealing means 9 are traversed by the flow of fluids from the upstream part of the well, assuming the fluid flow direction to be essentially from upstream part 18, moving toward inlet 15 to sealing means 9.

Reference 21 designates a connector. Reference 22 designates a connector with a lateral inlet allowing cable 14 to pass into annular gap 23 of the well. This design reduces and in some case eliminates the length of cable in the annular gap in the slanting or horizontal part of the well.

Cable 14 is installed and connected to the downhole connector in classical fashion.

At the wellhead, tubing 8 passes through a stuffing box 16 and has a valve 19 that controls the flows passing into the tubing. The wellhead has a system with a lateral inlet 31 allowing cable 14 to pass the outside, as well as pressure-measuring means and possibly pressure differential monitoring means.

The wellhead has s pipe 32 to carry the flow from annular zone 12, 13, and 23. This pipe has a valve 33 for controlling the flowrates in the annular zone.

The sealing means and tubing can be lowered into the gushing well when the latter is full of brine whose density is such that the well cannot produce. This is shown in FIG. 1.

Before the sealing means penetrate the unperforated part 34 of perforated liner 4, fluid is made to circulate through the tubing and The annular gap in order to expel the brine and cause the well to produce. Of course, when this operation is started, the wellhead is equipped with a stuffing box 16 and a lateral inlet system.

To allow tubing 8 and sealing means 9 to be lowered when the well is flowing, a shutoff device such as a valve 35 located above the lateral-inlet connector is used. This valve may be controlled by a cable when working with the wire line technique, or possibly with an electrical cable, in particular cable 14. In the latter case, it can be located below connector 21.

Thus, whenever it is desired to add or remove one tubing element, valve 35 is closed, valve 19 is removed, the tubing element is added or removed, valve 19 is replaced, and valve 35 is opened.

In this way, the sealing means may be located at the desired point in the perforated liner. According to the present invention, when flows are being measured the sealing means are immobile in the well.

When the well is producing and valves 19, 33, and 35 are open, the fluid coming essentially from the downstream part 17 and the fluid coming essentially from upstream part 18, considered in the flow direction relative to sealing means 9, are transferred to the surface via the annular zone and the tubing, respectively.

The fluid coming from downstream part 17 arrives at the surface via openings 36 in the perforated liner, and the fluid coming from upstream part 18 passes through the sealing means. Thus, selective measurement of the flows is obtained at the surface. One need then only move the sealing means by adding or removing a number of tubing elements to reach a new measuring location, and carry out measurements.

Establishment of a flow balance gives information on the changes in certain characteristics along the production hole. Thus, it is possible to find out, as a function of the curved abscissa of the hole, the local flowrate of the formation and its water, gas, oil, etc. composition utilizing control module 37 and display module 45 (FIG. 3) and information from sensors 10*a*, 10*b*, and 10*c*.

According to the present invention, a qualitative indication may be obtained of the circulation behind the perforated liner by causing the differential pressure to vary on either side of the sealing means, and then measuring it.

This measurement in fact determines the direction of the leak behind the liner, but cannot give any indication of the value of the leakage rate. It may be assumed, however, that this leakage rate is proportional to this pressure differential $Q^F=\alpha\Delta p$. It will therefore be zero if differential pressure $\Delta p$ is zero.

In FIG. 2, references 10*a* and 10*b* designate absolute, relative, or differential pressure sensors, which are connected to electronic control module 37 (FIG. 3) by lines 38.

The use of valves 19 and 33 allows the pressure losses to be varied in one of the two circuits formed, either by the annular zone (downstream circuit) or by the tubing (upstream circuit) and allows the error due to the leakage to be minimized by setting the differential pressure to zero. The characteristics of the leak behind the perforated liner may be evaluated as follows:

positioning of assembly in hole, adjustment of total throughput of well to a flowrate $Q_T$ measurement of upstream and downstream flows and pressure after adjusting the pressure differential to a value of zero $$Q_T=Q_d+Q_u$$

complete closure of valve 33, adjustment of flowrate of well by valve 19 in order to obtain the same pressure in the upstream part of the hole.

new flowrate $Q'_T=Q'_u$.

measurement of differential pressure $\Delta p$.

The leakage characteristic is then determined by $$\alpha' = \frac{Q'u - Qu}{\Delta p}$$

Also, by a particular adjustment of valves 19 and 33, an attempt may be made to bring about an artificial pressure differential on either side of the sealing means and to determine the leak from measurements of, in particular, the pressures and flowrates upstream and downstream.

In FIG. 3, electronic module 37 can make flowrate measurements by means of sensors 39 and 44 which are connected by lines 40 and 41, respectively.

Control module 37 can then control, by lines 42 and 43, valves 19 and 33 to reach a total flowrate, or a flowrate of one of the two circuits, equal to a predetermined flowrate. Display module 45 can indicate composition mixture and/or flowrate.

Up to now, transmission of information from the well bottom by electrical cable has been described.

It will not be a departure from the present invention to use transmission by electromagnetic waves, as described in the article by P. de Gauque and R. Grudzinski entitled "Propagation of Electromagnetic Waves Along a Drillstring of Finite Conductivity" in the journal *SPE Drilling Engineering*, June 1987. It will also not be a departure from the present invention to combine some of these different transmission means.

I claim:

1. Apparatus for creating production logs in a producing well, the well traversing a geological formation, said apparatus comprising:

a perforated liner within a producing zone of the well bore, and not cemented in the well bore, to define an annular space therebetween;

first means for positioning a sealing means within the liner in the well bore to divide the liner into an upstream part and a downstream part with respect to the sealing means;

second means for measuring a characteristic of the production in at least one of the upstream part and the downstream part;

third means for monitoring the pressure differential in the liner across the sealing means;

fourth means for controlling the pressure differential so as to control leakage of effluents between the upstream part and the downstream part; and fifth means for preparing production logs based on the measured values of said characteristic and the monitored pressure differential.

2. Apparatus as claimed in claim 1, wherein said well. third means is located at the earth's surface adjacent the well.

3. Apparatus as claimed in claim 1, wherein said second means is located at the earth's adjacent the

4. A device as claimed in claim 1, wherein said third means further measures the pressure existing in the upstream part and in the downstream part.

5. Apparatus as claimed in claim 1, further comprising a well tubing having a first end within the liner bore and a second end emerging from the well bore at the earth's surface, and sealing means attached to said first end of said well tubing.

6. Apparatus as claimed in claim 5, wherein the effluents coming from the upstream part flow to the earth's surface through said well tubing.

7. Apparatus as claimed in claim 5, or 6, wherein the effluents coming from the downstream part flow towards the earth's surface through the annular space.

8. A device as claimed in claim 5, wherein said well tubing has a side entry sub permitting a cable to pass from outside said tubing to inside said tubing.

9. Apparatus as claimed in claim 1, further comprising an electrical cable for transmission of information between instrumentation in the well bore and instrumentation at the earth's surface adjacent the well.

10. Apparatus as claimed in claim 1, further comprising electromagnetic wave transmission means for transmission of information between instrumentation in the well bore and instrumentation at the earth's surface adjacent the well.

11. Apparatus as claimed in claim 1, wherein said second means comprises means for measuring at least one of flow rate and composition mixture of the effluents coming from at least one of the upstream part and the downstream part.

12. A method of creating production logs in a producing well, the well traversing a geological formation, said method comprising the steps of:

(a) positioning a perforated liner within a producing zone of the well bore, without cementing the liner in the well bore, to define an annular space between the liner and the well bore;

(b) positioning sealing means within the liner in the well bore to divide the liner into an upstream part and a downstream part with respect to the sealing means;

(c) measuring a characteristic of the production from at least one of the upstream part and the downstream part;

(d) monitoring the pressure differential in the liner across the sealing means;

(e) controlling the pressure differential so as to control leakage of effluents between the upstream part and the downstream part; and (f) preparing production logs based on the measured values of said characteristic and the monitored pressure differential.

13. A method as claimed in claim 12, wherein step (c) is performed at the earth's surface adjacent the well.

14. A method as claimed in 12, wherein step (d) is performed at the earth's surface adjacent the well.

15. A method as claimed in claim 12, wherein step (c) comprises measuring flow rate and/or composition mixture of the effluents coming from at least one of the upstream part and the downstream part.

16. A method as claimed in claim 15, further comprising calculating preservation balances.

17. A method as claimed in claim 12, further comprising, between steps (e) and (f) , the steps of:

(g) moving the sealing means to another place in said well bore; and (h) repeating steps (a)-(e).

* * * * *